US011290823B2

(12) United States Patent
Kristiansen et al.

(10) Patent No.: US 11,290,823 B2
(45) Date of Patent: Mar. 29, 2022

(54) DOUBLE VOICE COIL LOUDSPEAKER TRANSDUCER UNIT

(71) Applicant: Dali A/S, Norager (DK)

(72) Inventors: Kim Kristiansen, Silkeborg (DK); Lars Risbo, Hvalso (DK); Bruno Putzeys, Achel (BE)

(73) Assignee: DALI A/S, Norager (DK)

( * ) Notice: Subject to any disclaimer, the term of this patent is extended or adjusted under 35 U.S.C. 154(b) by 0 days.

(21) Appl. No.: 17/046,206

(22) PCT Filed: Apr. 11, 2019

(86) PCT No.: PCT/DK2019/050115

§ 371 (c)(1),
(2) Date: Oct. 8, 2020

(87) PCT Pub. No.: WO2019/197001

PCT Pub. Date: Oct. 17, 2019

(65) Prior Publication Data

US 2021/0029463 A1 Jan. 28, 2021

(30) Foreign Application Priority Data

Apr. 11, 2018 (DK) ..... PA 2018 70214

(51) Int. Cl.
*H04R 9/02* (2006.01)
*H04R 9/06* (2006.01)

(52) U.S. Cl.
CPC ..... *H04R 9/027* (2013.01); *H04R 9/06* (2013.01)

(58) Field of Classification Search
CPC ..... H04R 9/025; H04R 9/027; H04R 9/06; H04R 2209/21
See application file for complete search history.

(56) References Cited

U.S. PATENT DOCUMENTS 4,856,071 A 8/1989 Marquiss
5,740,265 A 4/1998 Shirakawa
(Continued)

FOREIGN PATENT DOCUMENTS

CN 1509119 A 6/2004
CN 201854415 U 6/2011
(Continued)

OTHER PUBLICATIONS

International Search Report and Written Opinion dated May 23, 2019 in International Application No. PCT/DK2019/050115, 13 pages.
(Continued)

*Primary Examiner* — Sunita Joshi
(74) *Attorney, Agent, or Firm* — Berg Hill Greenleaf Ruscitti LLP

(57) ABSTRACT

The present invention discloses a loudspeaker driver comprising a magnet system having at least one gap where in each gap a voice coil assembly is arranged for movement in the gap, wherein either two distinct coils are arranged on the voice coil assembly, one above the other, and the magnet system comprises two pole pieces, one above the other, creating a pair of magnetized areas between said pole pieces and a yoke, such that a magnetic flux field is created between each pole piece and the yoke. In an alternative two concentric gaps are provided, where the voice coil assembly comprises two concentrically arranged sub-voice coils, where each sub-voice coil is provided with a distinct voice coil and the magnet assembly has two concentrically arranged magnet rings arranged with a yoke in the center, such that two concentric gaps are created, and that the voice coil assembly moves substantially orthogonal to the flux fields in the gap(s) and further that at least the part of each
(Continued)

pole piece facing the gap(s) is made from a soft magnetic composite (SMC) material.

8 Claims, 5 Drawing Sheets

(56) References Cited

U.S. PATENT DOCUMENTS

| | | | | |
|---|---|---|---|---|
| 6,158,109 | A | 12/2000 | Tannabe et al. | |
| 6,768,806 | B1 | 7/2004 | Button et al. | |
| 9,036,859 | B2 * | 5/2015 | Kristiansen | H04R 9/025 381/412 |
| 9,538,292 | B1 | 1/2017 | Boyd | |
| 2004/0131223 | A1 | 7/2004 | Stiles | |
| 2004/0156527 | A1 * | 8/2004 | Stiles | H04R 9/063 381/412 |
| 2006/0262956 | A1 | 11/2006 | Ishigaki et al. | |
| 2010/0038580 | A1 | 2/2010 | Ye et al. | |
| 2011/0170736 | A1 * | 7/2011 | Li | H04R 9/06 381/401 |
| 2013/0108100 | A1 | 5/2013 | Alvarez Ibarra | |
| 2014/0169615 | A1 * | 6/2014 | Kristiansen | H04R 9/025 381/412 |

FOREIGN PATENT DOCUMENTS

| | | | |
|---|---|---|---|
| DE | 3147169 | A1 | 7/1982 |
| DE | 19654156 | A1 | 7/1997 |
| WO | 0067523 | A2 | 11/2000 |
| WO | 2012149938 | A1 | 11/2012 |
| WO | 2016155353 | A1 | 10/2016 |

OTHER PUBLICATIONS

Danish Search Report dated Oct. 4, 2018 in Danish Application No. PA 2018 70214, 4 pages.
International Preliminary Report on Patentability dated Oct. 13, 2020, 10 pages.
CN Office Action dated Oct. 9, 2021, 8 pages.

* cited by examiner

DOUBLE VOICE COIL LOUDSPEAKER TRANSDUCER UNIT

CROSS REFERENCE TO RELATED APPLICATION

This application is a national stage application under 35 U.S.C. 371 of PCT Application No. PCT/DK2019/050115 having an international filing date of Apr. 11, 2019, which designated the United States, which PCT application claimed the benefit of Denmark Application Serial No. PA 2018 70214, filed Apr. 11, 2018, both of which are incorporated by reference in their entirety.

FIELD OF THE INVENTION

The present invention relates to a loudspeaker driver. Such drivers are used in loudspeakers to convert the power signal from an amplifier or the like to sound.

BACKGROUND OF THE INVENTION

In the art a number of different solutions to the construction of the magnet system have been suggested. When using magnet systems as drivers for generating the sound by moving the membrane it is customary to arrange a gap between two parts of the magnet system so that there will be a magnetic flux field arranged across this gap. In the gap is arranged a voice coil. The voice coil will move in the flux field in response to an alternating current induced in the coil. The magnetic flux field of the magnet will force the coil to move in the magnetic flux field substantially perpendicular to the direction of the flux lines making up the flux field and perpendicular to the direction of the current. The alternating current in the voice coil will when the voice coil is attached to a membrane generate the sound stemming from a loudspeaker.

In the art there are generally two types of magnet assembly designs, the first being overhung where a relatively wide voice coil is arranged in a relatively narrow gap in such a way that the actual extension of the coil exceeds the actual extension of the gap. The other principle commonly applied is a so-called underhung system where a relatively narrow coil is arranged in a relatively wide gap in such a way that the actual extension of the gap exceeds the actual extension of the voice coil.

The present invention is suitable with both types of designs as well as a neutral hung design, i.e. a design where the voice coil and the gap are of the same dimensions.

In general, it is desirable to obtain as linear a magnetic field across the air gap as possible in order to avoid distortion of the produced sound. The eddy currents will create distortion, and as such it is a desire to create a magnetic flux in the air gap which is substantially free of eddy currents.

A prerequisite for an accurate sound reproduction in a loudspeaker is that the sound waves produced by the moving membrane of the loudspeaker are as far as possible a true representation of the electrical voltage supplied to the loudspeaker. A wide range of parameters influence the accuracy of the wave form of the produced sound waves. One important parameter which has a great influence on the degree of the accuracy of the produced sound is the degree of linearity between the electrical signal supplied to the loudspeaker and the actual movement of the membrane.

Parameters influencing the accuracy in this movement of the membrane are at least two-fold. In order to obtain a high-fidelity response by the membrane on the supplied electrical signal the actual movement of the membrane should respond linearly to the electrical signal. In order to achieve such a linear response of the membrane the magnetic flux in the gap in which the coil is accommodated must be as homogenous as possible. The more homogenous flux the less distortion will result.

It is furthermore important that the roll-off strength of the B-field is as symmetrical as possible in that the curve representing the B-field as a function of the distance from the centre of the gap should exhibit similar characteristics in either actual direction from the centre of the gap. Hence, the curve representing the B-field as a function of the distance from the centre of the gap should as far as possible be symmetrical around the centre of the gap at distances falling within the gap as well as distances falling just outside the gap. In this way the so-called even harmonic distortion can be reduced. Furthermore, having a symmetrical roll-off strength of the B-field outside the gap implies that the coil may partly leave the gap without causing any unacceptable distortion. In other words, the less eddy currents present in the magnetic flux field between the conductive members surrounding the air gap, the better the linearity of the flux field is, and therefore the better the voice coil will respond in a linear fashion across the entire air gap and thereby in the loudspeaker's range.

The SMC material's characteristics depend on the composition of the SMC, i.e. the particle sizes, shapes, additives etc., but with the present invention it has been found that particles covered with an inorganic electrically insulating compound having a reduced air void content provides the advantages already mentioned above.

In a further advantageous embodiment the entire yoke and/or the entire top plate is made from the soft magnetic composite material.

The characteristics of the SMC material are such that it is possible to connect iron and SMC, for example by pressure (fuse them together) in such a manner that it is substantially indistinguishable where the limit is from one material to the other. Therefore, it is possible to produce raw blocks of composite materials forged with iron parts and thereafter work the pieces in to the desired shape.

The SMC material is distinguished from other materials by the fact that the iron powder particles are bound together in a ceramic sintering process, wherein an oxide layer is formed as the connecting boundary layer between the particles. As opposed to other materials where a polymer is used in order to connect/bind the particles together, a strong and rigid connection is provided. The polymer, although having very good electrically insulating properties is sensitive to temperature variations. In use the magnet system of a loudspeaker will heat up, whereby the polymer bound materials will become increasingly plastic and deformable. This will create distortion of the materials and thereby the sound generation.

In the art there are many different driver constructions suggested. The invention in question is of the dual coil type, meaning that on the voice coil are arranged two separate and distinct coils, and the magnet system has two pole pieces arranged with an air gap relative to a yoke, thereby creating two flux fields. The voice coils are energized and thereby due to electromagnetic forces move in the air gap/flux fields. When a membrane is attached to the voice coil, the membrane will move with the voice coil, thereby activate/excitate the ambient air (or particles in the air) creating a sound corresponding to the electrical signal activating the electromagnetic relationship between the magnets and the voice coils.

An example of a dual coil loudspeaker driver is disclosed in U.S. Pat. No. 6,768,806. In order to improve and/or control distortion etc. this loudspeaker driver uses shorting rings in various positions in the construction.

OBJECT OF THE INVENTION

It is an object of the present invention to increase the performance of prior art loudspeaker drivers in a simplified manner.

DESCRIPTION OF THE INVENTION

The invention is consequently directed at a loudspeaker driver comprising a magnet system having at least one gap where in each gap a voice coil assembly is arranged for movement in the gap, wherein either two distinct coils are arranged on the voice coil assembly one above the other, and the magnet system comprises two pole pieces one above the other, creating a pair of magnetized areas between said pole pieces and a yoke, such that a magnetic flux field is created between each pole piece and the yoke, or where two concentric gaps are provided, where the voice coil assembly comprises two concentrically arranged sub-voice coils, where each sub-voice coil is provided with a distinct coil and the magnet assembly has two concentrically arranged magnet rings arranged with a yoke in the center, such that two concentric gaps are created, and that the voice coil assembly moves substantially orthogonal to the flux fields in the gap(s) and further that at least the part of each pole piece facing the gap(s) is made from a soft magnetic composite (SMC) material.

Especially the use of soft magnetic composite material (SMC) provides for an extremely low generation of eddy currents in the gap. As these materials are typically more expensive than traditional iron material used for electromagnetic drive units, it is advantageous only to arrange the soft magnetic composite material (SMC) where eddy currents may influence the voice coil.

SMC is an isotropic iron-based material with a very low electrical conductivity, but with very high magnetic permeability and high saturation induction. With these properties the flux saturation is very high whereby the resulting magnetic flux becomes more even and consistent.

TABLE 1 relative comparison of relevant parameters.

| Type | Saturation level | Conductivity | Mechanical strength/ characteristics |
|---|---|---|---|
| Ordinary iron | Approx. 2.1 T | 0.097 μΩm | High |
| NiFe alloy | Approx. 1.6 T | 0.5 μΩm | high |
| Ironpowder sintered | Approx. 2 T | 0.1-0.5 μΩm | high |
| Ferrite MnFeO sintered | 0.4-0.5 T | 5.000.000 μΩm | brittle |
| Polymer adhered ironpowder | 1.9-2.1 T | 280-800 μΩm | Low (temperature dependent) |
| SMC ceramically bound | 1.9-2.1 T | 75-10.000 μΩm | medium |

For loudspeaker drivers of the electromagnetic drive unit type as described above it is important to have a high magnetic conductivity, but as small as possible electrically conductive characteristics. The electrically conductive materials will facilitate the creation of eddy currents and thereby the distortion already mentioned above. The SMC material is a poor electrical conductor whereas due to its relatively high iron content it has very good magnetic conductance. In comparison the electrical resistance, see also table 1, of for example pure iron is approximately 0.097 microΩmetre, for a sintered iron powder material the corresponding resistance is 1.0 microΩmetre whereas for SMC materials they have a resistance of approximately 400-8,000 microΩmetre depending on the composition of the soft magnetic composite. Consequently, using an SMC material in order to create a flux field the magnetic conductance is maintained whereas the electrical conductivity is a factor of approximately 10,000 less than that for traditional iron products whereby the creation of eddy currents is severely minimized. Therefore, the flux field in the air gap will be more homogenous such that increased linearity will be present.

Another factor influencing the performance over time of a flux field is the hysteresis magnetic property of the material which is discussed in for example GB 2022362. Due to its inherent construction with relatively poor electrical conductivity the SMC material will also have improved linearity relating to the hysteresis magnetic properties of the material.

In the variation of the invention where two concentric gaps are provided, and the voice coil assembly comprises two concentrically arranged sub-voice coils, such that each sub-voice coil is provided with a distinct coil and the magnet assembly has two concentrically arranged magnet rings arranged with a yoke in the center, whereby two concentric gaps are created, a sub-coil is arranged in each gap. This arrangement of the voice coil and the gaps provides for a very shallow construction height, but still a very powerful transducer unit, relative to its size.

In a further embodiment the two distinct coils on the voice coil are polarized in opposite directions. In this manner the self-induction being generated as the two coils move in the flux field is substantially canceled out by each other. Had the pole pieces been made from iron the generation of eddy-currents in the iron systems would have shielded the two coils from each other, such that the cancellation effect would not occur. However, using SMC reduces the generation of eddy-currents by a factor 100-10000, see the table above. Furthermore, at high frequencies this phenomenon is even more pronounced, such that the use of SMC becomes even more advantageous.

In another embodiment each pole piece has an extent "a" orthogonal to the flux field and each voice coil is arranged relative to the pole piece such that the voice coil when not polarized extends a distance of ½a into the flux field.

Clearly the flux field extends in both a linear and a non-linear manner from the pole pieces to the yoke, but at least for the purpose of this embodiment, reference to the flux field shall be construed as the strongest part of the flux-field, i.e. the substantially linear flux-lines between the pole piece and the yoke.

The condition of the voice coil as being not polarized, is intended to express a situation where no current is present in the coil and consequently no magnetic field is generated.

By arranging the coils according to this embodiment a substantial constant voice coil length is present in the flux field at any one time. As one voice coil moves out of the flux field the other voice coil moves further into the flux field. In this manner an even "power" is converted in the transducer.

In an embodiment each pole piece has an extent "a" orthogonal to the flux field and each voice coil when not polarized is arranged relative to the pole piece such that each voice coil overlaps a distance of ½a into the extent of each voice coil orthogonal to the flux field. With this arrangement the same effect is achieved—substantially the same length of voice coil is present in the gap at any time.

In a further embodiment of the loudspeaker, the voice coils are arranged with a minimum distance between the voice coils.

In this context the minimum distance is governed by at least two factors, the first factor being the physical dimensions of the pole pieces and the magnet separating the pole pieces. As the magnet will create a spacing between the pole pieces this allows the member on which the voice coils are arranged to have a certain length in the gap, accommodating the coils. The length of the coils, i.e. the number of windings, is also a limiting factor, i.e. the more windings the longer extend in the gap. It is therefore considered that the skilled person will recognize these limiting factors when carrying out the invention. The design of the pole pieces and the separating magnet is influenced by desired characteristics of the loudspeaker per se.

The minimum distance is also determined by the fact that a distance of ½a of the voice coil shall extend into the flux field in the non-polarized state.

In another embodiment the voice coils are arranged with a maximum distance between the voice coils.

Again this arrangement is limited by outside factors in particular the fact that a distance of ½a of the voice coil shall extend into the flux field in the non-polarized state. This embodiment is not so sensitive to the geometric relationship between the pole pieces and the separating magnet.

In general it is desirable to have as much coil material in the gap as possible. For this reason the loudspeaker in a further embodiment is provided with voice coil(s) where the windings are made with an electrically conductive wire having a four-sided crosssection. It is not desirable to have more than one layer of windings but at the same time, it is desirable to have as much conductive material as possible in the voice coil. If multiple layers of windings are present they will when energized create an uncontrollable magnetic field. However, by using wires which have a rectangular or square cross-section (four sided cross-section) the conductive material density is increased as compared to wires having a circular cross-section.

In a further embodiment the yoke is provided with flux focusing means, and optionally also the pole pieces opposite the flux focusing means on the yoke are provided with flux focusing means.

The flux focusing means will typically be ring-shaped protrusions of the pole piece respectively the yoke, extending towards the yoke respectively pole piece in the direction of the flux field, such that the flux from the saturated pole pieces and yoke will be focused providing better linearity in the flux field. The flux focusing means may also be a taper or decreasing thickness in the material from which the pole piece respectively yoke is manufactured from, towards the gap.

Again the use of SMC is greatly advantageous as compared to iron, in that the coils due to the lack of eddy-currents can "see" each other, and in that manner counter or cancel the generated eddy-currents, where iron pole pieces would not benefit due to eddy-currents which would counteract each other. In a focused flux field this effect for iron would just be increased and cause a detrimental effect on the performance of the loudspeaker.

The use of SMC in this manner provides a stronger B-field (the force imparted from the magnets to the coils wires).

DESCRIPTION OF THE DRAWING

The invention will now be described with reference to the accompanying drawing.

Figure 3:
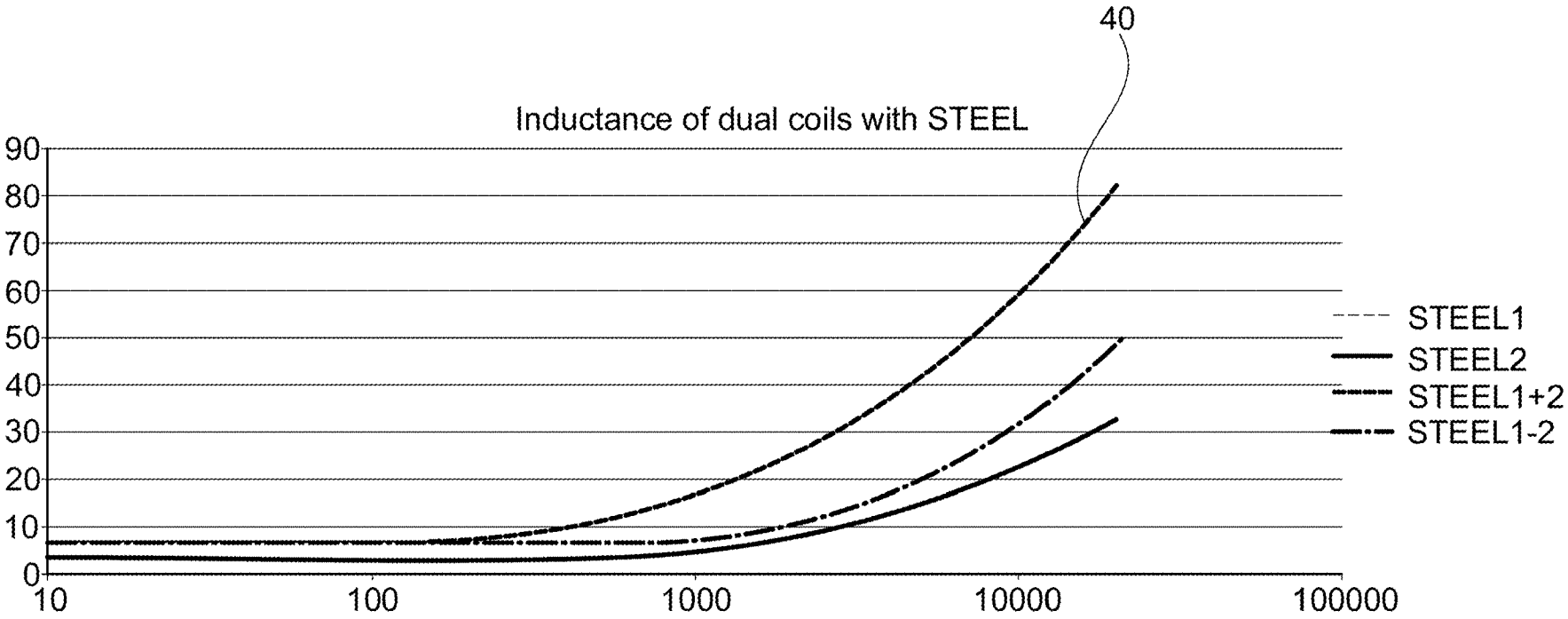
Figure 4:
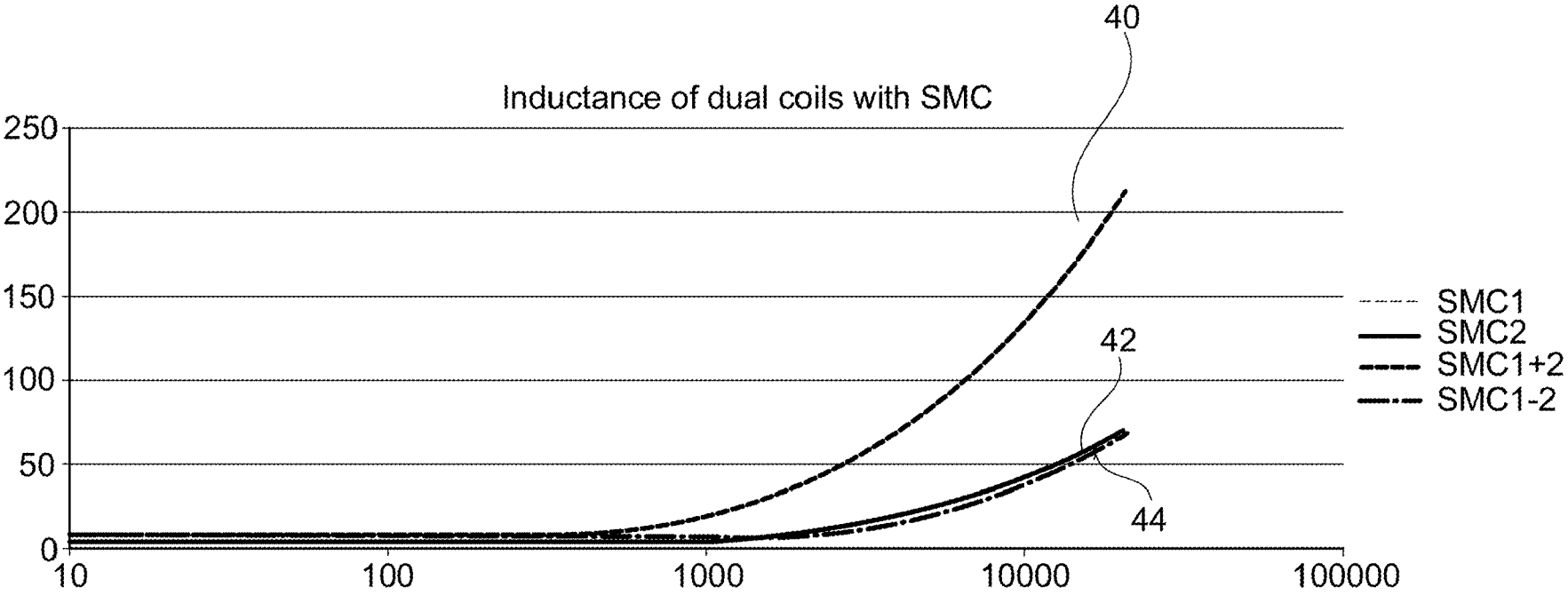
Figure 5A:
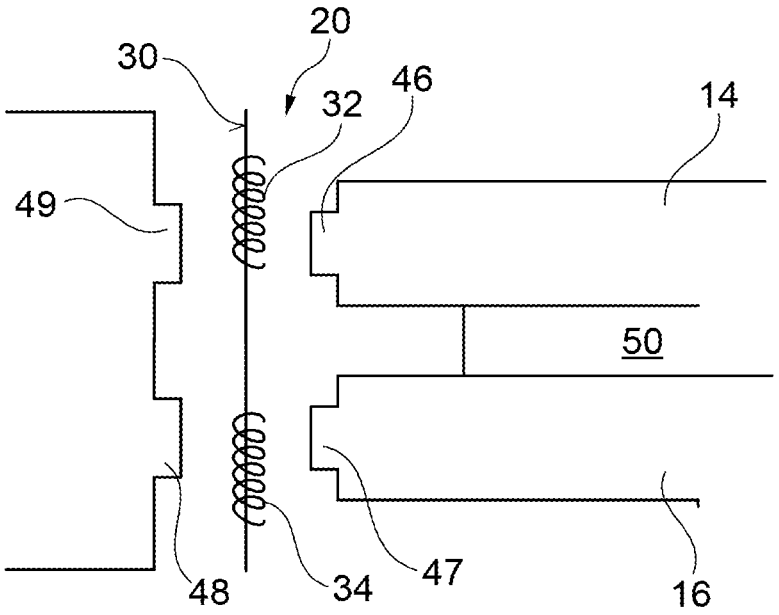
Figure 5B:
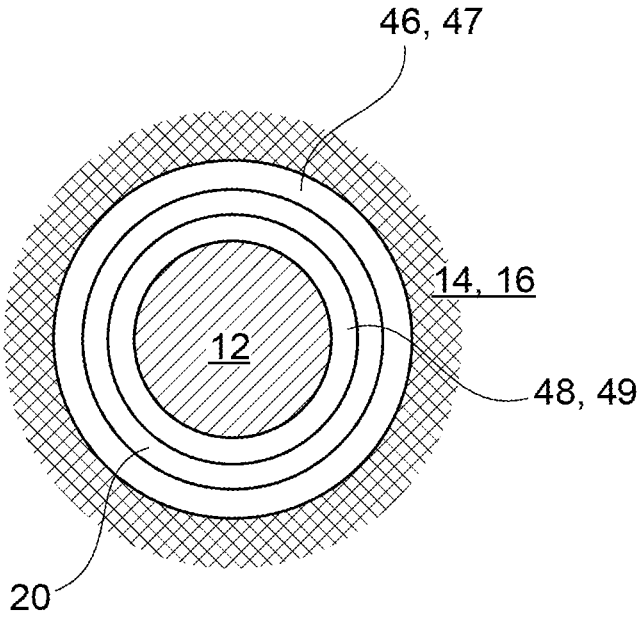
Figure 6:
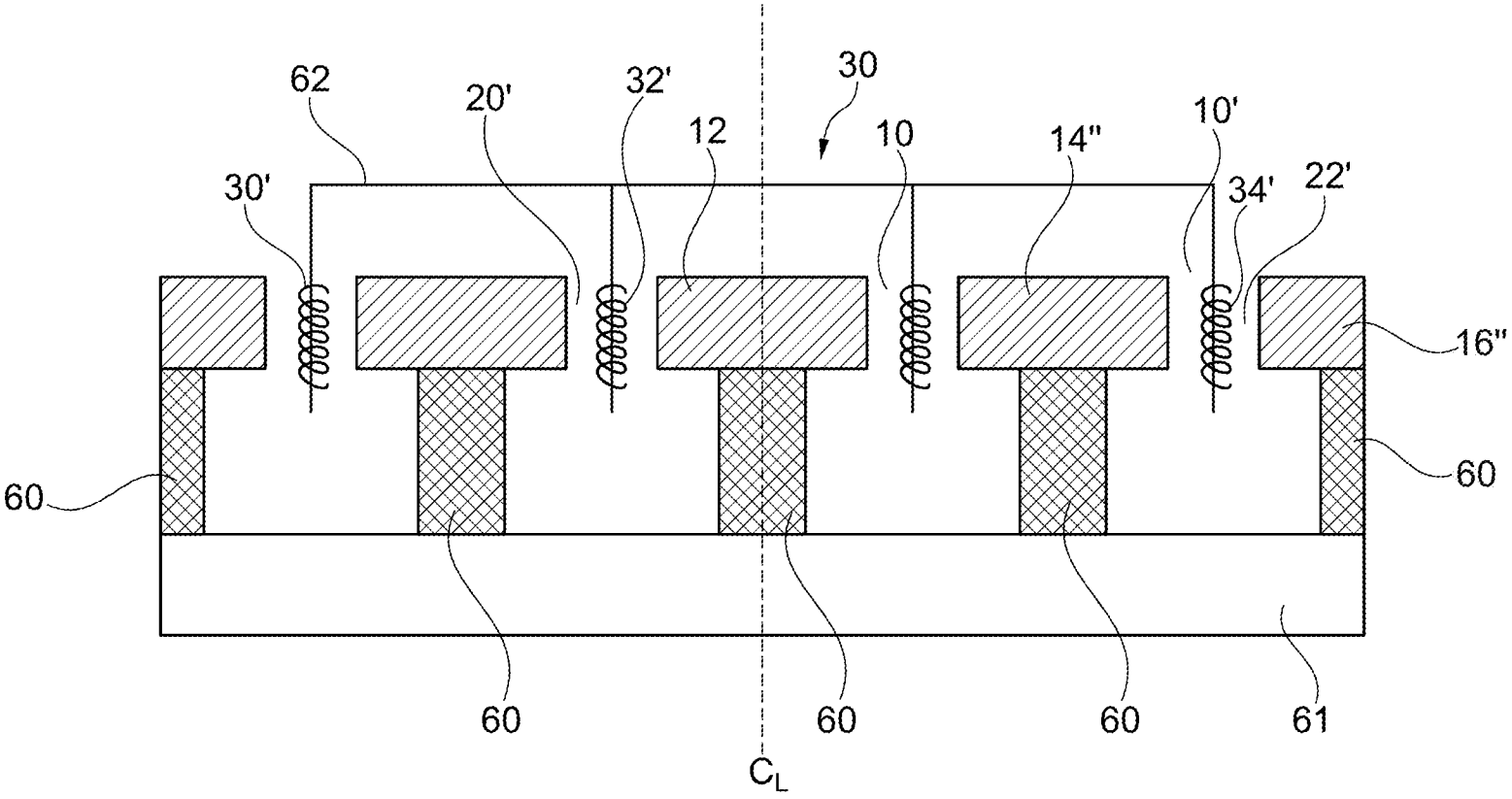

In the FIGS. 3 and 4 the respective inductance of various combinations of materials are illustrated as a function of the frequency;

In FIGS. 5*a* and 5*b* is illustrated the dual coil system provided with special flux-focusing means;

In FIG. 6 is illustrated a cross-section through a transducer unit having two concentric gaps and voice coils.

DETAILED DESCRIPTION OF THE INVENTION

Figure 1:
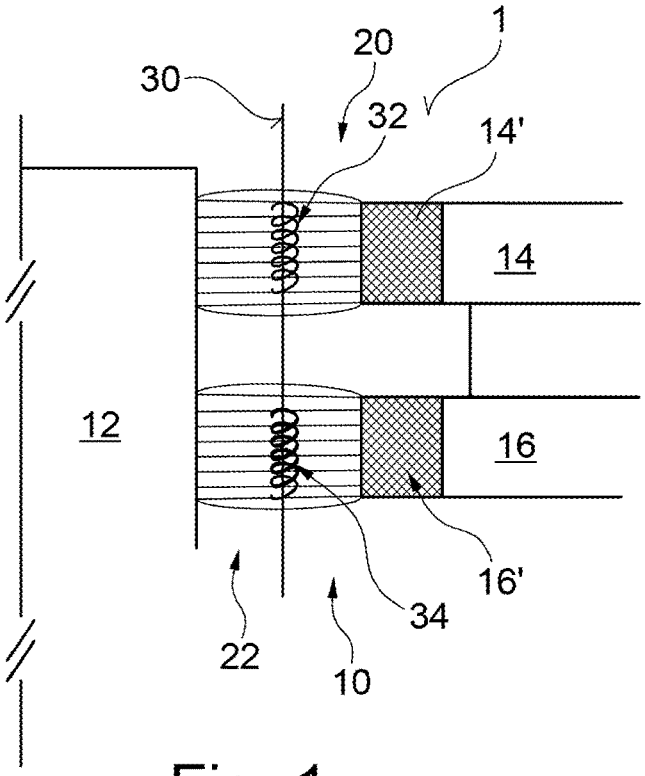
In FIG. 1 is shown a section of a loudspeaker driver.

In FIG. 1 is shown a section of a loudspeaker driver according to the invention. In the figure is illustrated part of the loudspeaker driver 1 where an air gap 10 is arranged between a yoke 12 and two pole pieces 14, 16. In this manner two distinct magnetic flux fields 20, 22 are created between each pole piece 14, 16 and the yoke 12. The voice coil assembly 30 has two distinct coils 32, 34 arranged on the voice coil where the two distinct coils 32, 34 are arranged to be positioned in separate flux fields 20, 22. The voice coils 32, 34 have been mounted such that they have opposite polarity whereby the self-induction in the two coils 32, 34 substantially cancels each other out. In this manner the system's self-induction is greatly reduced.

At least a part 14', 16' of each pole piece facing the gap is made from a soft magnetic composite (SMC) material. As SMC is more expensive than regular iron, the use of SMC is used with a view to associated cost and obtained performance. The entire pole piece and yoke may be manufactured from SMC.

The SMC material provides extremely low generation of eddy currents in the gap and as such particularly when using two distinct voice coils 32, 34 in the gap, the substantial reduction of eddy currents in the voice coils facilitate that the two coils do not interfere with each other such that they may be arranged very close to each other on the voice coil assembly 30. In this manner a powerful (due to the two coils) but very compact driver unit may be constructed.

In table 1 (see above) are listed conductivity characteristics for typical materials. As is evident from the table, SMC reduces eddy currents depending on the composition of the SMC material between 100-10,000 times with respect to the other materials listed and particularly with respect to ordinary iron the reduction is approximately 10,000 times. This is a substantial reduction for these types of systems.

Figure 2:
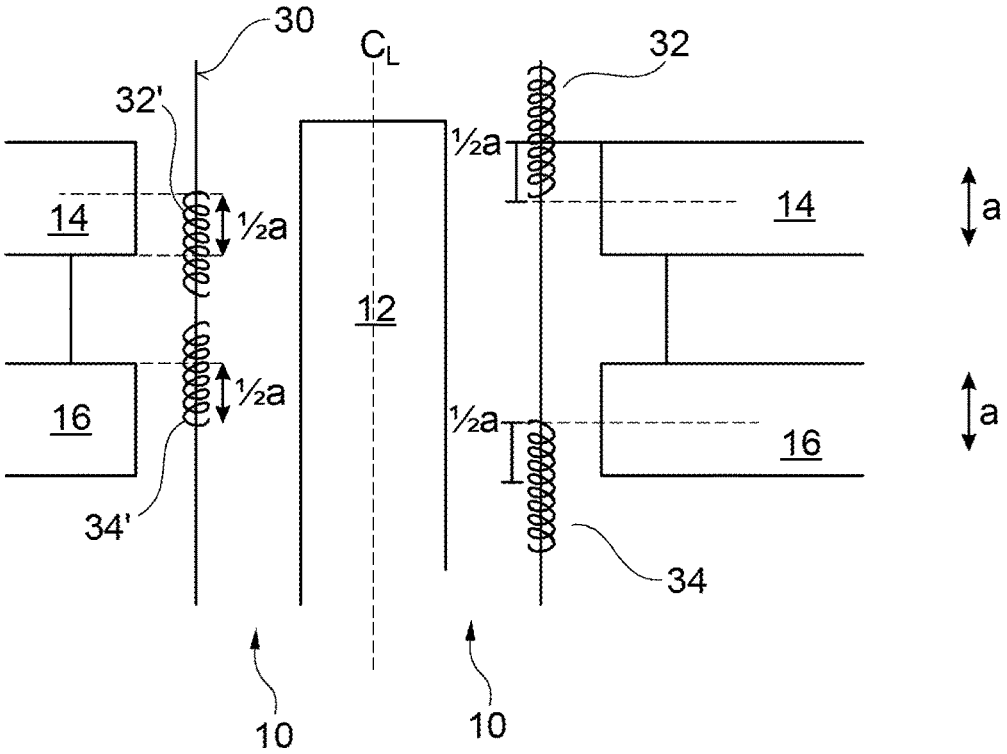
In FIG. 2 are illustrated two variations of an embodiment where the two voice coils are arranged in a different manner in the gap.

In FIG. 2 is illustrated two variations of an embodiment where the two voice coils are arranged in a different manner in the gap 10 as compared to the embodiment described above with reference to FIG. 1. The pole pieces have a thickness orthogonal to the flux field of "a".

In the embodiment illustrated on the right hand side in FIG. 2 the voice coils 32, 34 are displaced by ½a such that the upper voice coil 32 extends ½a into the flux field created by the pole piece 14 and the yoke 12. Likewise the voice coil 34 extends ½a into the flux field created by the pole piece 16 and the yoke 12.

In the variation illustrated on the left hand side, the voice coils 32', 34' likewise extend ½a into the flux field created by the pole piece 14, 16 and the yoke 12. Due to the fact that at least part of the pole pieces 14, 16 are made from an SMC material, the voice coils can be arranged in close proximity as illustrated on the left hand side variation of the embodiment illustrated in FIG. 2 without interfering with each other. By this arrangement it is furthermore achieved that substantially a constant length of voice coil 32, 34, 32', 34' is present in the flux field as the voice coil 30 moves up and down in the gap 20.

In FIG. 2 the pole pieces 14, 16 are not illustrated as having SMC material facing the air gap, but naturally at least part of each pole piece facing the gap may likewise be made from a soft magnetic composite. This is especially important when the benefits as explained above are to be achieved, particularly when the voice coils 32', 34' are arranged in close proximity as is the case in the variation on the left hand side of the embodiment illustrated in FIG. 2.

By arranging the voice coils as illustrated with FIG. 2 an almost perfect symmetry is achieved in that the voice coils will move such that as part of one coil leaves its respective flux field, the other coil is forced further into its respective flux field.

In the FIGS. 3, 4 and 5 the respective inductance of various combinations of material are illustrated as a function of the frequency.

Basically the use of SMC materials with respect to iron-based material is that SMC reduces self-inductance.

In FIG. 3 is illustrated the performance of a SMC-based transducer unit. The curves are the result of an extensive testing in a laboratory, and consequently reflect actual measurements derived from dual coil drivers.

The inductance increases from approx. 1000 Hz and upwards—(midtone speakers towards tweeters). The upper curve 40 illustrates the aggregated inductance of the two coils separately, whereas the curve 42 illustrates the inductance of each coil separately—i.e. the coils are identical, but wound in opposite directions.

The curve illustrates a drive unit built as described above with reference to FIGS. 1 and 2, where SMC material is used on the pole pieces and the yoke. It is clear that the generated inductance cancels out to a value lower than each separate coil (i.e. 1+1 equals more than 2). The two coils therefore have a beneficial relationship, resulting in a better dampening than what could otherwise be expected, when measuring the two coils separately.

A corresponding pattern is illustrated in FIG. 4, where the driver is made from traditional iron-based material. It appears that the inductance of this system cancels out only to a degree between the sum of the coils and each separate coil.

Overall the SMC cancels out with a dual coil arrangement as discussed above to about the same level of iron based materials, and therefore reaps the benefits of iron and the superior characteristics of SMC at the same time.

By using SMC the eddy-currents are greatly reduced as compared to iron—a factor 100 to 10000, due to the low conductivity of SMC as compared to iron—see table 1 above. The combination of very little eddy currents and the compact construction as suggested in the present invention, assures that the two coils' self-induction substantially is compensated/cancelled, and at the same time the coils will be exposed to (able to see) equal amounts of iron, and thereby generate a symmetry in the construction to the benefit of the resulting characteristics of the system.

Iron systems shield the two coils from each other due to the relatively high presence of eddy currents and particularly at higher frequencies the eddy current loss is significant, whereas with SMC based systems, and thereby inherent very low eddy currents the coils can see each other at all frequencies, assuring improved performance over the entire frequency range.

In FIG. 5*a* the dual coil system is provided with special flux-focusing means 46, 47, 48, 49, whereby the magnetic flux field in the gap 20 is more focused. Due to the relatively large distance between the coils (32, 34) on the voice coil (30), and the fact that the SMC materials can see each other (which is not the case in iron systems) the focused flux fields have a large effect as compared to comparable iron systems. On the other hand it is also desirable, with respect to the B-field, to provide a relatively thick magnet (50) between the two pole pieces (14,16), in order to space the pole pieces.

In FIG. 5*b* is schematically illustrated a plane view of a loudspeaker driver 1 comprising a yoke 12, surrounded by pole pieces 14,16, Between the yoke 12 and the pole pieces 14, 16 is provided the air gap 20 in which the voice coil (not illustrated) reciprocates in and out of the plane of the figure. The flux focusing means 46, 47, 48, 49 are in this embodiment in the shape of ring-shaped protrusions in intimate and conductive contact with the yoke and the pole pieces respectively, such that the magnetic flux from the yoke and pole pieces can be concentrated across the air gap.

In FIG. 6 is illustrated a cross-section through a transducer having two gaps 10, 10'. The gaps 10, 10' are concentrically arranged around the yoke 12'. In each circular gap 10, 10' is arranged a voice coil 32', 34'. As was the case as explained with reference to FIG. 1 two distinct flux fields 20', 22' are created in the gaps 10, 10'. On either side of the gaps 10, 10' is arranged SMC material. In practice the pole pieces 14", 16" are rings of SMC material arranged on top of ring magnets 60. The ring magnets 60 are in contact via an iron piece 61.

The voice coils 32', 34' are arranged in the gaps 10, 10' and held by a voice coil assembly plate 62, which either directly or indirectly is in contact with the loudspeaker membrane/cone (not illustrated).

The invention claimed is:

1. A loudspeaker driver comprising:

a magnet system having at least one gap where in each gap a voice coil assembly is arranged for movement in the gap, wherein either two distinct coils are arranged on the voice coil assembly, one above the other, and the magnet system comprises two pole pieces, one above the other, creating a pair of magnetized areas between said pole pieces and a yoke, such that a magnetic flux field is created between each pole piece and the yoke, or where two concentric gaps are provided, where the voice coil assembly comprises two concentrically arranged sub-voice coils, where each sub-voice coil is provided with a distinct voice coil and the magnet assembly has two concentrically arranged magnet rings arranged with a yoke in the center, such that two concentric gaps are created, and that the voice coil assembly moves substantially orthogonal to the flux fields in the gap(s) and further that at least the part of each pole piece facing the gap(s) is made from a soft magnetic composite (SMC) material; and wherein the yoke is provided with flux focusing means, and wherein optionally also the pole pieces opposite the flux focusing means on the yoke are provided with flux focusing means.

2. The loudspeaker driver according to claim 1, wherein the two distinct coils on the or each voice coil assembly are polarized in opposite directions.

3. The loudspeaker driver according to claim 1, wherein each pole piece has an extent "a" orthogonal to the flux field and where each voice coil when not polarized is arranged relative to the pole piece such that the extent of the voice coil extends a distance of ½a into the flux field.

4. The loudspeaker river according to claim 3, wherein when the voice coils are arranged on the same voice coil, the coils are arranged with a minimum distance between the voice coils.

5. The loudspeaker driver according to claim 3, wherein when the voice coils are arranged on the same voice coil, the coils are arranged with a maximum distance between the voice coils.

6. The loudspeaker according to claim 1 wherein the flux focusing means is a taper or decreasing thickness towards the rim in the material from which the pole piece respectively yoke is manufactured.

7. The loudspeaker according to claim 1 wherein the windings are made with an electrically conductive wire having a four-sided cross-section.

8. The loudspeaker according to claim 1 wherein the concentrically arranged sub-voice coils are connected to a plate arranged orthogonal to the direction of movement of the coils.

* * * * *